US008844207B2

(12) United States Patent
Bowers et al.

(10) Patent No.: US 8,844,207 B2
(45) Date of Patent: Sep. 30, 2014

(54) PORTABLE DANCE FLOOR PANEL WITH FLOATING MAGNET RETENTION SYSTEM

(71) Applicant: Mity-Lite, Inc., Orem, UT (US)

(72) Inventors: Brian Bowers, Midvale, UT (US); Mitchell Health, Payson, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 13/908,852

(22) Filed: Jun. 3, 2013

(65) Prior Publication Data

US 2014/0245692 A1 Sep. 4, 2014

Related U.S. Application Data

(60) Provisional application No. 61/655,371, filed on Jun. 4, 2012.

(51) Int. Cl.
*E04H 3/28* (2006.01)
*E04F 15/02* (2006.01)

(52) U.S. Cl.
CPC ..... *E04F 15/02* (2013.01); *Y10S 52/04* (2013.01); *Y10S 248/90* (2013.01); *Y10S 428/90* (2013.01)
USPC ..... 52/7; 428/900; 52/DIG. 4; 248/900

(58) Field of Classification Search
CPC ..... Y10S 52/04; Y10S 248/90; E04B 2002/7468; E04H 3/28
USPC ..... 52/DIG. 4; 428/900
See application file for complete search history.

(56) References Cited

U.S. PATENT DOCUMENTS 3,512,324 A * 5/1970 Reed ..... 52/588.1
3,852,935 A 12/1974 Jones
5,117,596 A * 6/1992 Leslie et al. ..... 52/126.6
5,634,309 A * 6/1997 Polen ..... 52/392

(Continued)

FOREIGN PATENT DOCUMENTS

EP 1 830 014 3/2006
WO WO 96/04441 2/1996

OTHER PUBLICATIONS

Versare Portable Dance Floor; http://web.archive.org/web/20100314163519/http://www.portableplatforms.com/products/... Accessed on May 31, 2012; 1 page.
Mity-Lite; Magnattach Portable Dance Floor; ©2011; 2 pages.

(Continued)

*Primary Examiner* — Andrew J Triggs
(74) *Attorney, Agent, or Firm* — Thorpe North & Western LLP

(57) ABSTRACT

A portable dance floor system comprises a plurality of floor panels removably couplable together to form a dance floor assembly, with each floor panel comprising a perimeter frame circumscribing a core, and a dance floor surface substantially covering the frame and core. The frame has an extrusion with an outwardly facing channel having an opening, and an elongated cavity behind the channel. A plurality of bores can extend into the extrusion from a back of the extrusion, into the channel, and to the opening. A plurality of magnets can each be disposed in a different one of the plurality of bores. A retaining strip can be disposed in the elongated cavity and can hold the plurality of magnets in the plurality of bores between the retaining strip and the opening. The panel can include the core having an aluminum honeycomb between aluminum skins.

20 Claims, 7 Drawing Sheets

(56) References Cited

U.S. PATENT DOCUMENTS

| | | | | |
|---|---|---|---|---|
| 6,189,283 | B1 | 2/2001 | Bentley et al. | |
| 6,446,413 | B1 * | 9/2002 | Gruber | 52/747.11 |
| 8,033,074 | B2 | 10/2011 | Pervan et al. | |
| 8,112,967 | B2 | 2/2012 | Pervan et al. | |
| 8,181,416 | B2 | 5/2012 | Pervan et al. | |
| 2003/0042256 | A1 * | 3/2003 | Johnson et al. | 220/216 |
| 2010/0086377 | A1 * | 4/2010 | de Mola | 411/176 |
| 2010/0319291 | A1 * | 12/2010 | Pervan et al. | 52/588.1 |

OTHER PUBLICATIONS

Mity-Lite; Sales Literature; Magnattach® Portable Dance Floor; http://www.mitylite.com/magnattach/index.html; accessed on May 31, 2012; 3 pages.

Mity-Lite; Specifications; Magnattach® Portable Dance Floor; Durable Lightweight Tables & Chairs; 1 page; Apr. 2011.

* cited by examiner

PORTABLE DANCE FLOOR PANEL WITH FLOATING MAGNET RETENTION SYSTEM

PRIORITY CLAIM

Priority is claimed to U.S. Provisional Patent Application Ser. No. 61/655,371, filed Jun. 4, 2012, which is hereby incorporated herein by reference.

BACKGROUND

1. Field of the Invention

The present invention relates generally to portable and modular dance floors.

2. Related Art

Portable dance floors allow a temporary dancing surface to be provided in a multi-purpose area, such as a banquet hall, or even outside. The portable dance floor can include floor panels joined together by mechanical means to form a larger dance floor. The panels can be assembled and disassembled as desired. Some dance floors include a magnetic attachment. The dance floor includes a perimeter frame of extruded aluminum channel circumscribing a perimeter of the panel, and covered by a laminate floor surface, and with a balsawood and paper spacer between a floor and the laminate. Magnets are disposed in the channel to hold adjacent channels, and floor panels, together. For example, see Magnattach® Portable Dance Floors by Mity-Lite®, and U.S. Pat. No. 5,634,309. Some dance floors also have a honeycomb core. See Versare Portable Dance Floors.

SUMMARY OF THE INVENTION

It has been recognized that it would be advantageous to develop a portable dance floor with panels that have an improved strength and durability and an improved floating magnet retention system.

The invention provides a portable dance floor system comprising a plurality of floor panels removably couplable together to form a dance floor assembly. Each floor panel comprises a perimeter frame circumscribing a core, and a dance floor surface substantially covering the frame and core. The frame comprises an extrusion with an outwardly facing channel having an outward facing opening, and an elongated cavity behind the channel. A plurality of bores extends into the extrusion transverse to a longitudinal axis thereof from a back of the extrusion, into the channel, and to the opening of the channel. A plurality of magnets is each disposed in a different one of the plurality of bores. A retaining strip is disposed in the elongated cavity and holds the plurality of magnets in the plurality of bores between the retaining strip and the opening. The retaining strip and the extrusion are non-ferrous. The plurality of magnets has a diameter smaller than a diameter of the plurality of the bores, or the plurality of magnets has a length shorter than a distance from the opening to the retaining strip, or both, such that the plurality of magnets are movable within the plurality of bores.

In addition, the invention provides a dance floor system comprising a plurality of floor panels removably couplable together to form a dance floor assembly. Each floor panel comprises an aluminum honeycomb core and a perimeter frame circumscribing the core. The frame comprises an extrusion with an outwardly facing channel with an outward facing opening, and an elongated cavity behind the channel. An upper aluminum layer extends over the core and over substantially all of the frame. A lower aluminum layer extends under the core and under substantially all of the frame. The core and the perimeter frame are sandwiched between the upper and lower aluminum layer. A dance floor surface is disposed over the upper aluminum layer and substantially covers the frame. A plurality of bores is each wider than the channel and each extends from a bottom of the channel to short of the outward facing opening defining a pair of opposing lips extending inward over the bore to form a reduced width with respect to the bore. A plurality of magnets is each disposed in a different one of the plurality of bores. The plurality of magnets each has a length extending from the pair of lips into a respective bore in the bottom of the channel. A retaining strip is disposed in the elongated cavity and holds the plurality of magnets in the plurality of bores between the retaining strip and the opening. The retaining strip and the extrusion are non-ferrous. The plurality of magnets has a diameter smaller than a diameter of the plurality of the bores, or the plurality of magnets has a length shorter than a distance from the opening to the retaining strip, or both, such that the plurality of magnets are movable within the plurality of bores.

In addition, the invention provides a portable dance floor system comprising a plurality of floor panels removably couplable together to form a dance floor assembly. Each floor panel comprises a perimeter frame circumscribing a core, and a dance floor surface substantially covering the frame and core. The core comprises an aluminum honeycomb between aluminum skins.

Furthermore, the invention provides a portable dance floor system comprising a plurality of floor panels removably couplable together to form a dance floor assembly. Each floor panel comprises a perimeter frame circumscribing a core, and a dance floor surface substantially covering the frame and core. A pair of layers sandwiches the core and the perimeter frame between the layers. The dance floor surface is disposed over one of the pair of layers.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Figure 1A:
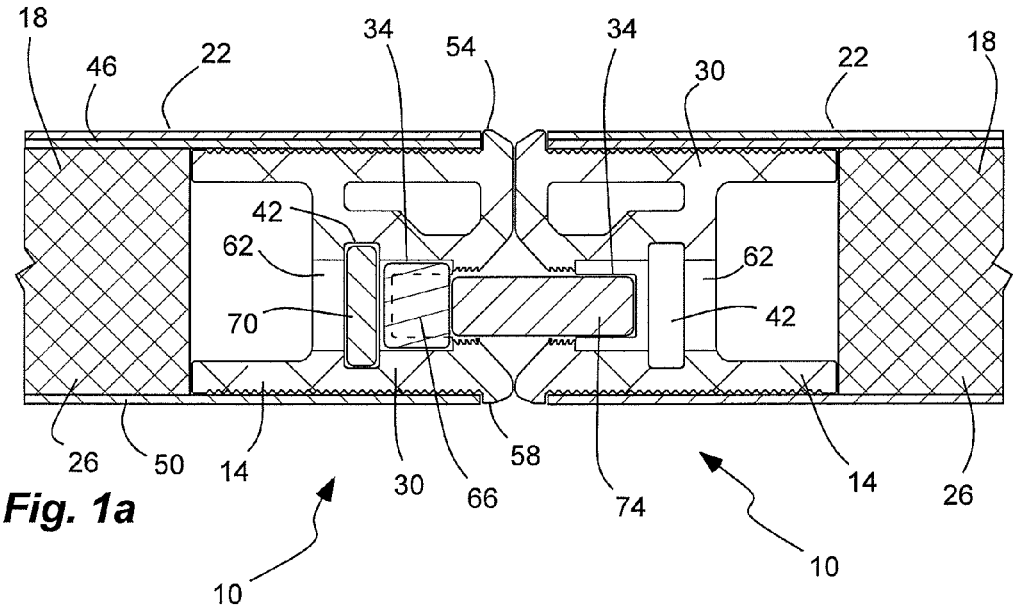
FIG. 1*a* is a partial cross-sectional side view of a portable dance floor system showing a pair of adjacent floor panels joined together.
Figure 1B:
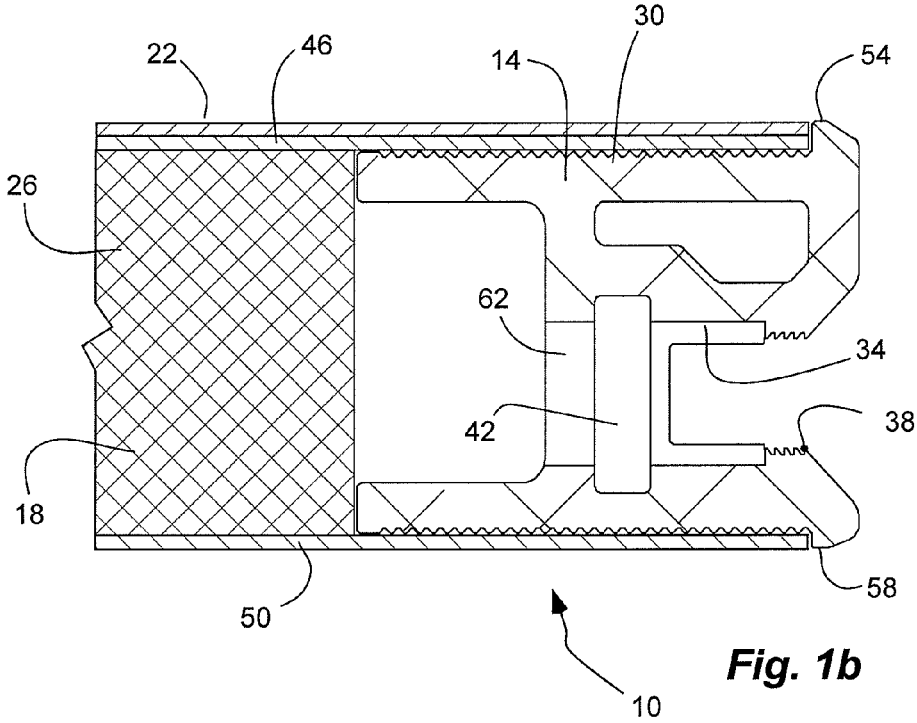
FIG. 1*b* is a partial cross-sectional side view of the panel of FIG. 1*a;*
Figure 1C:
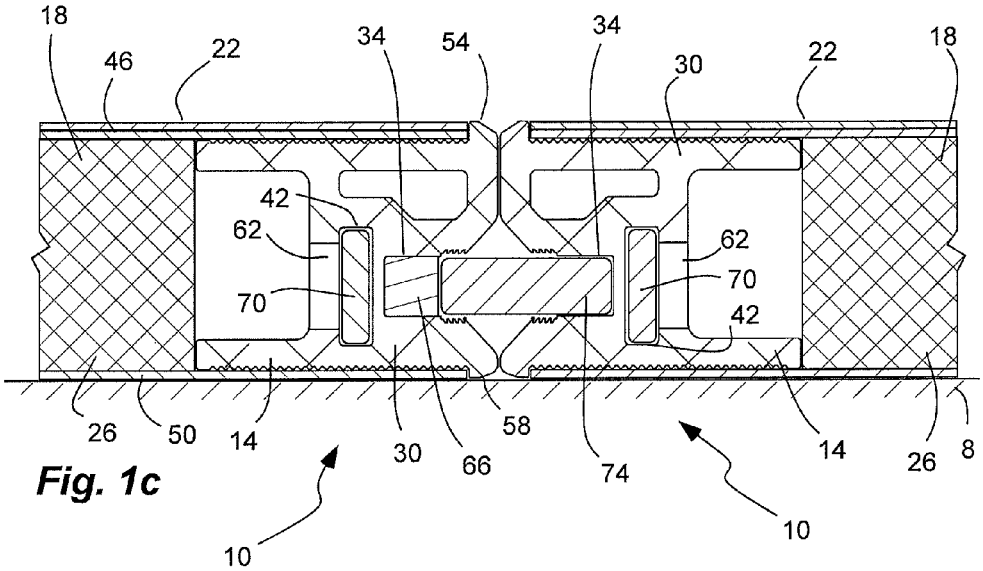
FIG. 1*c* is a partial cross-sectional side view of the pair of adjacent floor panels of FIG. 1*a;*
Figure 1D:
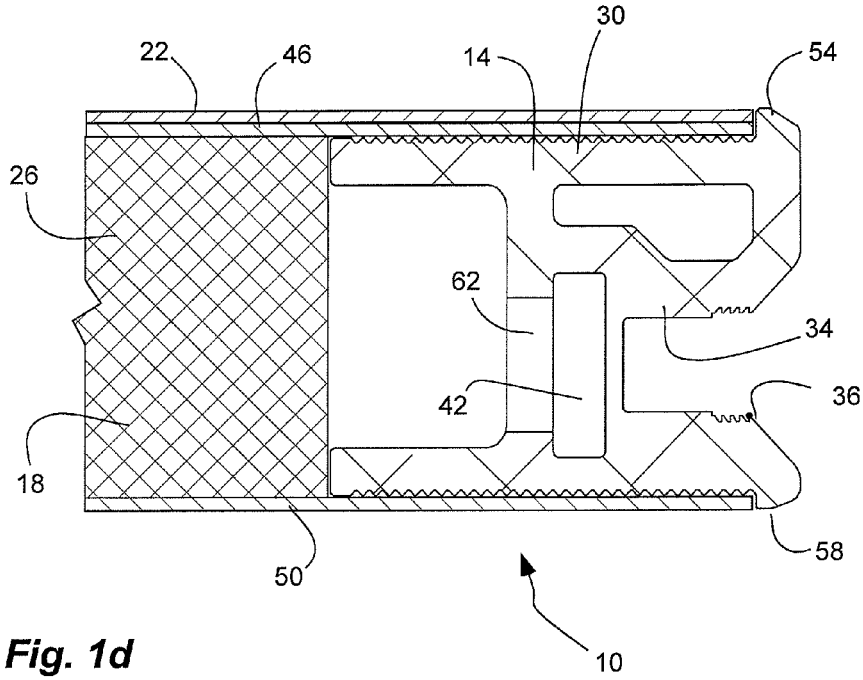
FIG. 1*d* is a partial cross-sectional side view of the panel of FIG. 1*a;*
Figure 2C:
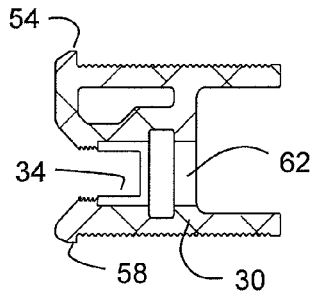
FIG. 2*c* is a cross-sectional side view of the extrusion of FIG. 2*a* taken along line 2*c;*
Figure 2D:
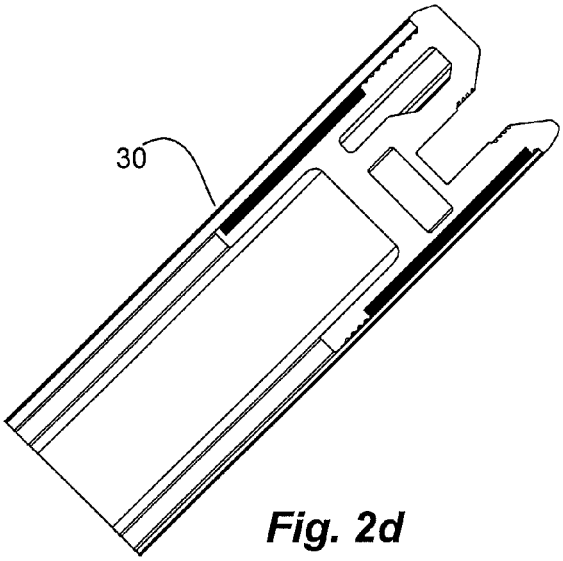
FIG. 2*d* is an end view of the extrusion of FIG. 2*a* taken along line 2*d;*
Figure 2E:
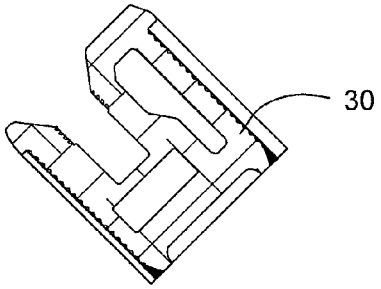
FIG. 2*e* is a cross-sectional end view of the extrusion of FIG. 2*a* taken along line 2*e;*
Figure 2A:
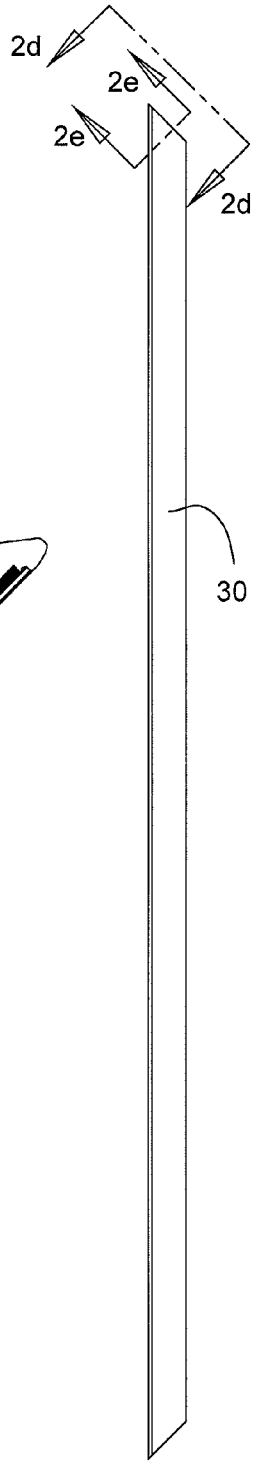
FIG. 2*a* is a top view of an extrusion of a frame of the floor panel of FIG. 1*a;*
Figure 2B:
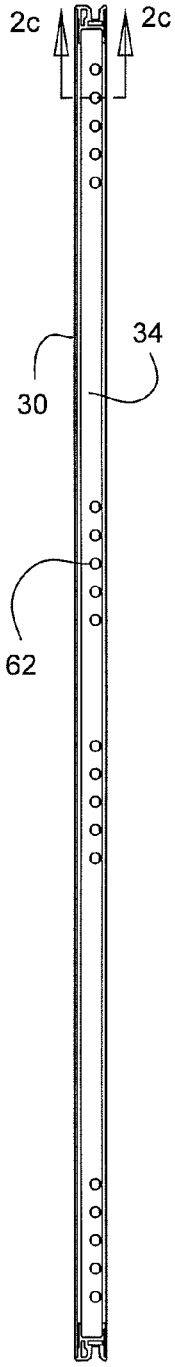
FIG. 2*b* is a side view of the extrusion of FIG. 2*a;*
Figure 2F:
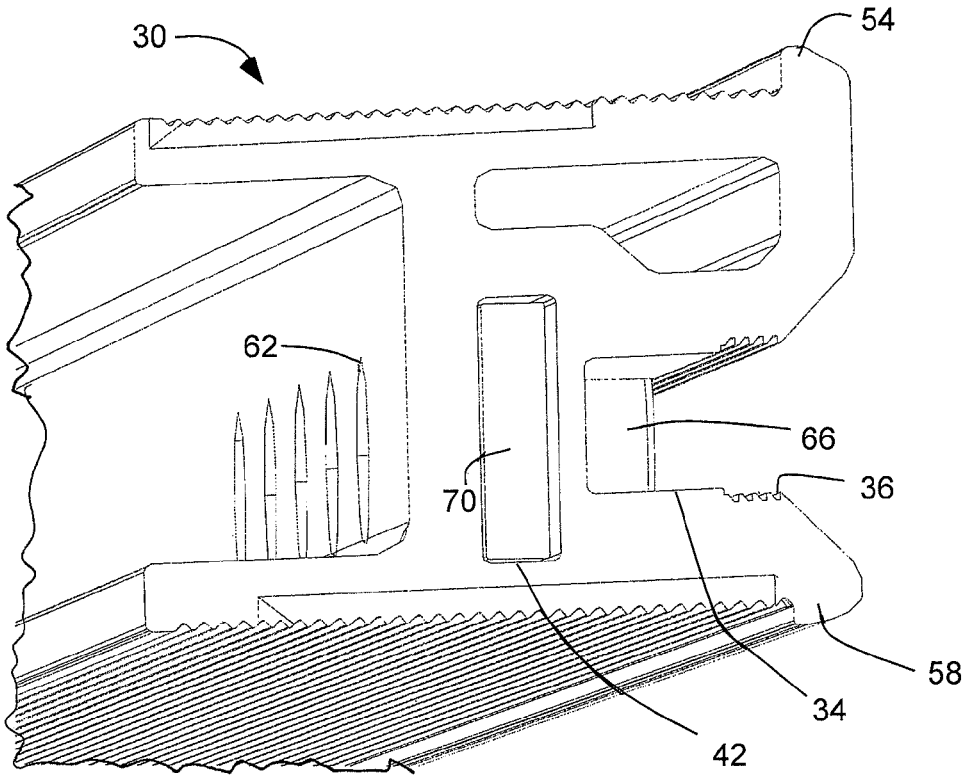
FIG. 2*f* is a partial perspective end view of the extrusion of FIG. 2*a* with magnets and a retaining strip therein.
Figure 2G:
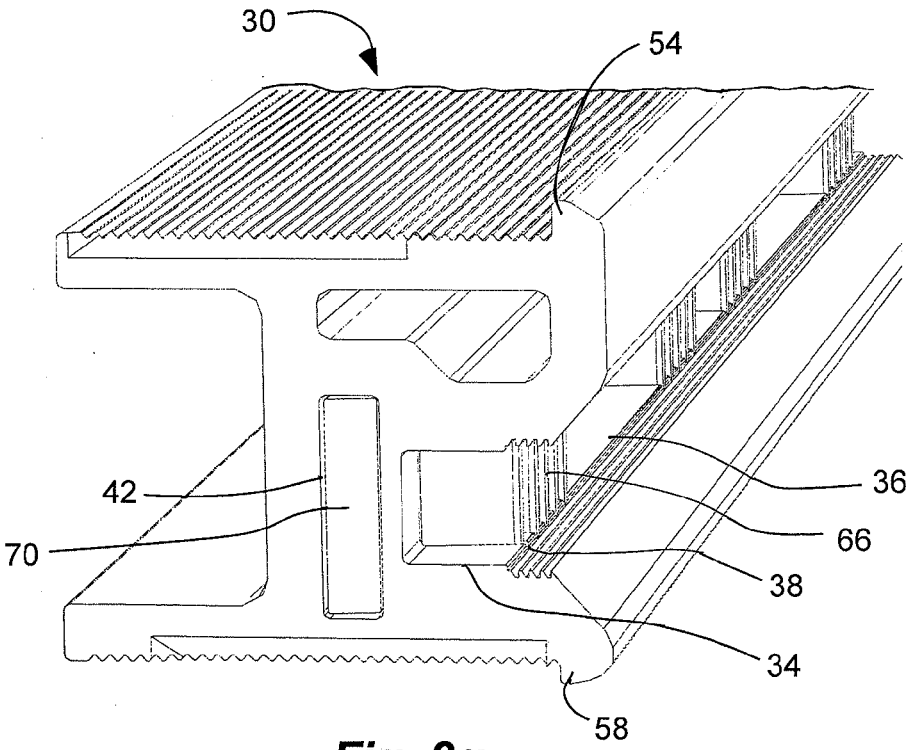
FIG. 2*g* is a partial perspective end view of the extrusion of FIG. 2*a* with magnets and the retaining strip therein.
Figure 3B:
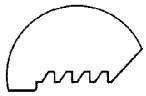
FIGS. 3*b-g* are detail views of the extrusion of FIG. 3*a;*
Figure 3C:
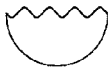
Figure 3D:
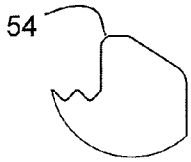
Figure 3A:
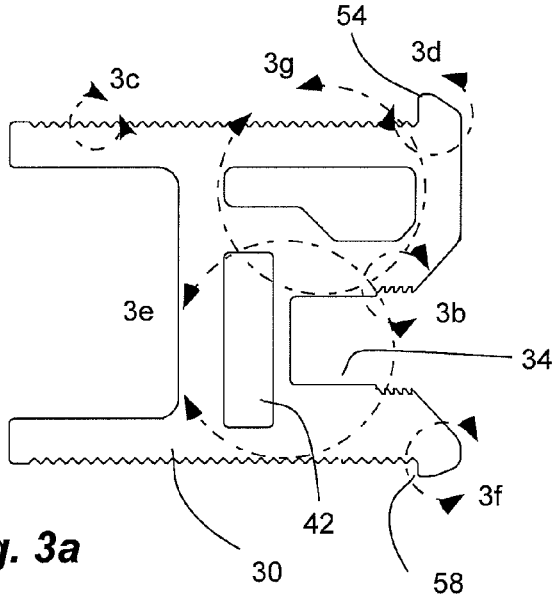
FIG. 3*a* is an end view of the extrusion of the frame of the floor panel of FIG. 1*a;*
Figure 3E:
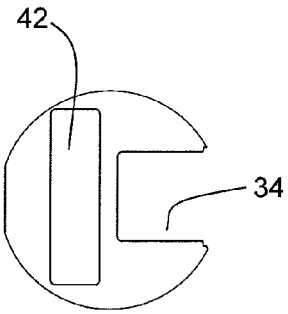
Figure 3G:
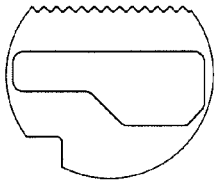
Figure 3F:
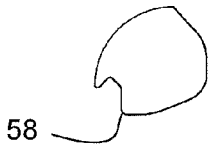
Figure 4:
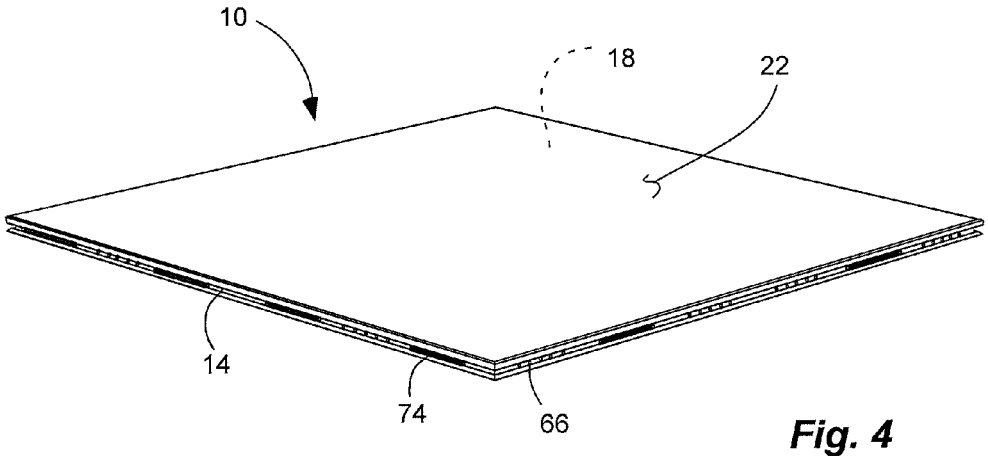
FIG. 4 is a perspective view of a floor panel of the portable dance floor system of FIG. 1*a;*
Figure 5:
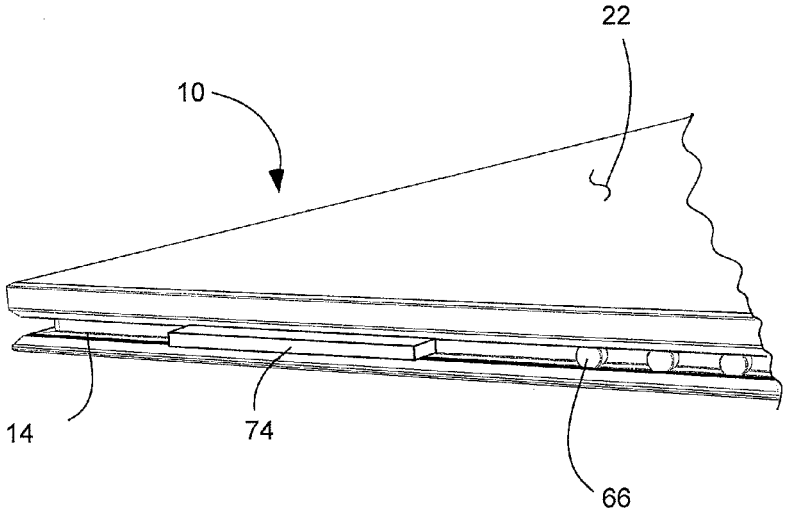
FIG. 5 is a partial perspective view of the floor panel of the portable dance floor system of FIG. 1*a*.
Figure 6:
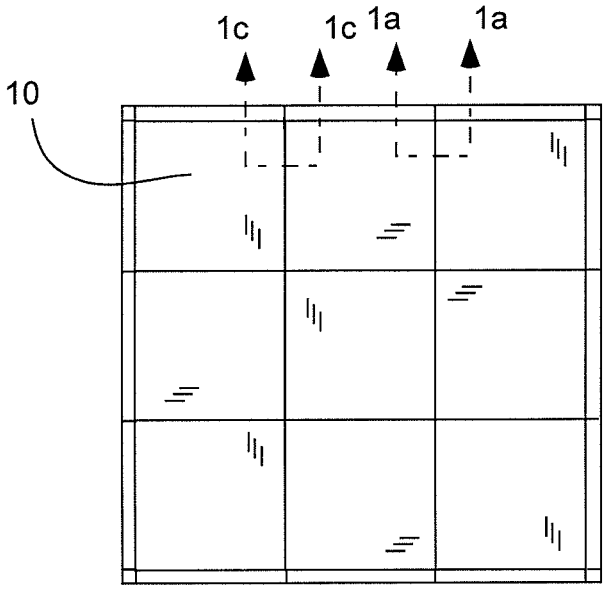
FIG. 6 is a top view of the portable dance floor system or assembly in accordance with an embodiment of the invention.

As illustrated in FIGS. 1*a*-6, a portable dance floor system comprising a plurality of floor panels, indicated generally at 10, in an example implementation in accordance with the invention is shown that is removably couplable together to form a dance floor assembly. Such an assembly can be disposed on a support surface 8 (FIG. 1*c*), such as a floor or the ground. The support surface can be carpet, wood, concrete or ever grass or dirt. The panels, and thus the assembly, can have an upper dance surface that is hard, flat, substantially smooth, and aesthetically pleasing to form a dance floor to receive users or dancers thereon in the act of dancing and similar activities. A perimeter edge, similar in construction and similarly removably couplable with the floor panels, but with a beveled or inclined upper surface extending from the support surface to the dance surface, can circumscribe the plurality of floor panels to form a gradual transition from the support surface to the dance surface. The panels and thus the assembly can have a thickness between 0.5 to 1.5 inches in one aspect, 0.75 to 1.25 inches in another aspect, or of approximately 1.13 inches in another aspect.

The panels 10 can be formed of a perimeter frame 14 circumscribing a core 18, and with a dance floor surface 22 substantially covering the frame and core. The core 18 can include a honeycomb 26 with vertically oriented walls and vertically oriented cavities extending in a direction of a thickness of the floor. The honeycomb can be formed of or can include aluminum, and can be an aluminum honeycomb core. The frame 14 can include an extrusion 30 with an outwardly facing channel 34 having an outward facing opening 36 (or having a reduced opening 38 with respect to the bores 62). (Thus, the opening 38 can include inwardly facing, opposing lips or flanges at the bores 62 so that the reduced opening has a width less than a width of the bores 62.) In addition, the extrusion 30 can have an elongated cavity 42 behind the channel 34 and oriented along a length or longitude of the extrusion. The cavity 42 and the channel 34 can be elongated and parallel with respect to one another. The extrusion 30 can be formed of or can include aluminum, or another non-ferrous material. The extrusions 30 can be straight with mitered ends welded or held together to form squares (or rectangles, or other shapes with straight multiple sides, such as octagons, etc.). The size of the panels can be 3×3 feet, 4×4 feet, etc. The perimeter frame 14 and the core 18 can be coupled together to form a solid panel with both the frame and the core contributing the structural integrity of the panel. A pair of layers, such as an upper and lower layers or skins 46 and 50, can sandwich the core 18 and the perimeter frame 14 between the layers. The layers or skins can be aluminum and can be adhered to the core and the frame. Thus, the layers or skins can extend over and under the core and substantially all of the frame. The frame, core and layers form a stiff, rigid panel that is capable of retaining its shape and flatness, even in more extreme conditions, including humidity and heat. It will be appreciated that the aluminum materials of the core, frame and layers can resist warping due to moisture and heat, including thermally induced stress.

The dance floor surface 22 is disposed over the upper layer or skin 46, and substantially covers the frame 14. The dance floor surface can be a laminate. The lower layer or skin 50 can have an exposed bottom surface that can directly contact or abut the support surface 8. Thus, the panels can be used outdoors on damp or wet surfaces. Both the upper and lower outer edges of the extrusion 30 can include a lip, such as an upper outer lip 54 and a lower outer lip 58. The upper outer lip 54 forms a shallow upper cavity on a top of the frame. The upper layer 46 and the dance floor surface 22 can be disposed in the upper cavity. The outer perimeter edges of the upper layer 46 and the dance floor surface 22 can extend substantially to the upper outer lip 54; and the uppermost surface of the dance floor surface and the lip can terminate at substantially the same elevational height and be substantially flush to provide a smooth surface. Similarly, the lower outer lip 58 on the extrusion 30 forms a shallow bottom cavity on a bottom of the frame. The lower aluminum layer 50 can be disposed in the shallow bottom cavity. The outer perimeter edge of the lower layer 50 can extend substantially to the lower outer lip 58; and the lowermost surface of the lower layer and the lower outer lip can be substantially flush to provide a smoother surface to resist snagging on the support surface.

In addition, the floor panels can have a magnetic retention system that releasably couples adjacent panels together. The magnets can have a floating retention system to allow some play or movement of the magnets. A plurality of bores 62 can extend into the extrusion 30 transverse to a longitudinal axis thereof, from a back of the extrusion, into the channel 34, and to the reduced opening or lips 38 or flanges thereof. The plurality of bores 62 is each wider than the channel 34 and each extends from a bottom of the channel 34 to short of the outward facing opening 36 to form a reduced width with respect to the bore and defining the pair of opposing lips 38 extending inward over the bore. The bores 62 can be, or can have diameters, larger than the width of the channel, but less than the reduced opening. A plurality of magnets 66 can each be disposed in a different one of the plurality of bores 62. The plurality of magnets 66 each has a length extending from the pair of lips 38 into a respective bore 62 in the bottom of the channel. Thus, the magnets 66 are prevented from exiting the opening 36 of the channel by the lips 38, and are prevented from traveling along the channel by their larger diameters in the bores, and being disposed in the bore in the bottom of the channel. For example, the bores 62 can be formed by drilling the extrusion 30 from behind; and the magnets 66 inserted from behind through the opening or leading end of the bore. A retaining strip 70 can be disposed in the elongated cavity 42, and can hold the plurality of magnets 66 between in the plurality of bores 62 between the retaining strip and the reduced opening or lips. For example, the retaining strip can be inserted into the elongated cavity from an end of the extrusion after the magnets have been inserted. Thus, the magnets are physically maintained in the bores by the bore walls and the lips on one end and the retraining strip on the other end, without the use of mechanical fasteners or chemical adhesives. In addition, the size (diameter and/or length) of the magnets is less than the size of the bores (diameter and/or length) and there is a space or gap therebetween such that the magnets have a limited range of movement in the bores. The retaining strip 70 and the extrusion 30 can be non-ferrous; and the plurality of magnets 66 can have a diameter smaller than a diameter of the plurality of the bores 62, or the plurality of magnets 66 can have a length shorter than a distance from the reduced opening or lips to the retaining strip, or both, such that the plurality of magnets 66 are movable within the plurality of bores 62. The magnets can be or can include neodymium.

A rib or blade 74 can be disposed in and extend from a channel 34 in an adjacent panel. The rib or blade 74 can be ferrous, such as steal, to make a magnetic connection with the magnets between the adjacent panels. In addition, the rib or blade 74 can form a vertical lock between the panels to resist the panels from displacing vertically with respect to one another.

The panels can be formed by extruding the extrusion and cutting the extrusion to length and mitering the ends. The bores can be drilled. The magnets and retaining strips can be inserted. The ribs or blades can be inserted and secured. The cut extrusions can be welded together. The core can be cut to size and placed in the frame. The upper and lower layers can be cut to size and placed in the shallow cavities and adhered to the core and the frame. The dance floor surface can be adhered to the upper layer.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A portable dance floor system comprising a plurality of floor panels removably couplable together to form a dance floor assembly, each floor panel comprising:

a) a perimeter frame circumscribing a core, and a dance floor surface substantially covering the frame and core;

b) the frame comprising an extrusion with an outwardly facing channel having an outward facing opening, and an elongated cavity behind the outwardly facing channel;

c) a plurality of bores extending into the extrusion transverse to a longitudinal axis thereof from a back of the extrusion, into the outwardly facing channel, and to the outwardly facing opening of the outwardly facing channel;

d) a plurality of magnets each disposed in a different one of the plurality of bores;

e) a retaining strip disposed in the elongated cavity and holding the plurality of magnets in the plurality of bores between the retaining strip and the opening; and f) the retaining strip and the extrusion being non-ferrous;

g) the plurality of magnets having a diameter smaller than a diameter of the plurality of the bores, or the plurality of magnets having a length shorter than a distance from the outwardly facing opening to the retaining strip, or both, such that the plurality of magnets are movable within the plurality of bores.

2. A system in accordance with claim 1, wherein a) the plurality of bores is each wider than the outwardly facing channel and each extends from a bottom of the outwardly facing channel to short of the outward facing opening to form a reduced width with respect to the bore and defining a pair of opposing lips extending inward over the bore; and b) the plurality of magnets each has a length extending from the pair of lips into a respective bore in the bottom of the outwardly facing channel.

3. A system in accordance with claim 1, wherein the core comprises an aluminum honeycomb core.

4. A system in accordance with claim 1, further comprising:

a) an upper layer extending over the core and over substantially all of the frame;

b) a lower layer extending under the core and under substantially all of the frame;

c) the core and the perimeter frame being sandwiched between the upper and lower layer; and d) a dance floor surface disposed over the upper layer and substantially covering the frame.

5. A system in accordance with claim 4, further comprising:

a lower outer lip on the extrusion forming a shallow bottom cavity on a bottom of the frame with the lower layer disposed in the shallow bottom cavity.

6. A system in accordance with claim 4, wherein the lower layer has an exposed bottom surface.

7. A system in accordance with claim 1, further comprising:

a blade secured in the outwardly facing channel separate from the plurality of magnets and extending out from the outwardly facing channel and beyond a perimeter of the frame, the blade comprising a ferrous material to magnetically attach to another adjacent plurality of magnets of another adjacent panel.

8. A portable dance floor system comprising a plurality of floor panels removably couplable together to form a dance floor assembly, each floor panel comprising:

a) a honeycomb core;

b) a perimeter frame circumscribing the core, the frame comprising an extrusion with an outwardly facing channel with an outward facing opening, and an elongated cavity behind the outwardly facing channel;

c) an upper layer extending over the core and over substantially all of the frame;

d) a lower layer extending under the core and under substantially all of the frame;

e) the core and the perimeter frame being sandwiched between the upper and lower layer;

f) a dance floor surface disposed over the upper layer and substantially covering the frame;

g) a plurality of bores each wider than the outwardly facing channel and each extending from a bottom of the outwardly facing channel to short of the outward facing opening defining a pair of opposing lips extending inward over the bore to form a reduced width with respect to the bore;

h) a plurality of magnets each disposed in a different one of the plurality of bores;

i) the plurality of magnets each having a length extending from the pair of lips into a respective bore in the bottom of the outwardly facing channel;

j) a retaining strip disposed in the elongated cavity and holding the plurality of magnets in the plurality of bores between the retaining strip and the outwardly facing opening;

k) the retaining strip and the extrusion being non-ferrous; and l) the plurality of magnets having a diameter smaller than a diameter of the plurality of the bores, or the plurality of magnets having a length shorter than a distance from the outwardly facing opening to the retaining strip, or both, such that the plurality of magnets are movable within the plurality of bores.

9. A system in accordance with claim 8, further comprising:

a lower outer lip on the extrusion forming a shallow bottom cavity on a bottom of the frame with the lower layer disposed in the shallow bottom cavity.

10. A system in accordance with claim 8, wherein the lower layer has an exposed bottom surface.

11. A system in accordance with claim 8, further comprising:

a blade secured in the outwardly facing channel separate from the plurality of magnets and extending out from the outwardly facing channel and beyond a perimeter of the frame, the blade comprising a ferrous material to magnetically attach to another adjacent plurality of magnets of another adjacent panel.

12. A portable dance floor system comprising a plurality of floor panels removably couplable together to form a dance floor assembly, each floor panel comprising:

a) a perimeter frame circumscribing a core, and a dance floor surface substantially covering the frame and core;

b) a pair of layers sandwiching the core and the perimeter frame between the layers, and with the dance floor surface disposed over one of the pair of layers;

c) the frame comprising an extrusion with an outwardly facing channel having an outward facing opening, and an elongated cavity behind the channel;

d) a plurality of bores extending into the extrusion transverse to a longitudinal axis thereof from a back of the extrusion, into the outwardly facing channel, and to the outwardly facing opening of the outwardly facing channel;

e) a plurality of magnets each disposed in a different one of the plurality of bores;

f) a retaining strip disposed in the elongated cavity and holding the plurality of magnets in the plurality of bores between the retaining strip and the outwardly facing opening;

g) the retaining strip and the extrusion being non-ferrous; and h) the plurality of magnets having a diameter smaller than a diameter of the plurality of the bores, or the plurality of magnets having a length shorter than a distance from the outwardly facing opening to the retaining strip, or both, such that the plurality of magnets are movable within the plurality of bores.

13. A system in accordance with claim 12, wherein a) the plurality of bores is each wider than the outwardly facing channel and each extends from a bottom of the outwardly facing channel to short of the outward facing opening to form a reduced width with respect to the bore and defining a pair of opposing lips extending inward over the bore; and b) the plurality of magnets each has a length extending from the pair of lips into a respective bore in the bottom of the outwardly facing channel.

14. A system in accordance with claim 12, further comprising:

a lower outer lip on the extrusion forming a shallow bottom cavity on a bottom of the frame with a lower layer of the pair of layers disposed in the shallow bottom cavity.

15. A portable dance floor system comprising a plurality of floor panels removably couplable together to form a dance floor assembly, each floor panel comprising:

a) a perimeter frame circumscribing a core, and a dance floor surface substantially covering the frame and core;

b) the frame comprising an extrusion with an outwardly facing channel having an outward facing opening, and an elongated cavity behind the outwardly facing channel;

c) a plurality of bores extending into the extrusion transverse to a longitudinal axis thereof from a back of the extrusion, into the outwardly facing channel, and to the outwardly facing opening of the outwardly facing channel;

d) a plurality of magnets each disposed in a different one of the plurality of bores;

e) a retaining strip disposed in the elongated cavity and holding the plurality of magnets in the plurality of bores between the retaining strip and the outwardly facing opening; and f) the retaining strip and the extrusion being non-ferrous;

g) the plurality of magnets having a size less than a size of the plurality of the bores, such that the plurality of magnets are movable within the plurality of bores.

16. A system in accordance with claim 15, wherein a) the plurality of bores is each wider than the outwardly facing channel and each extends from a bottom of the outwardly facing channel to short of the outward facing opening to form a reduced width with respect to the bore and defining a pair of opposing lips extending inward over the bore; and b) the plurality of magnets each has a length extending from the pair of lips into a respective bore in the bottom of the outwardly facing channel.

17. A system in accordance with claim 15, further comprising:

a) an upper layer extending over the core and over substantially all of the frame;

b) a lower layer extending under the core and under substantially all of the frame;

c) the core and the perimeter frame being sandwiched between the upper and lower layer; and d) a dance floor surface disposed over the upper layer and substantially covering the frame.

18. A system in accordance with claim 17, further comprising:

a lower outer lip on the extrusion forming a shallow bottom cavity on a bottom of the frame with the lower layer disposed in the shallow bottom cavity.

19. A system in accordance with claim 17, wherein the lower layer has an exposed bottom surface.

20. A system in accordance with claim 15, further comprising:

a blade secured in the outwardly facing channel separate from the plurality of magnets and extending out from the outwardly facing channel and beyond a perimeter of the frame, the blade comprising a ferrous material to magnetically attach to another adjacent plurality of magnets of another adjacent panel.

* * * * *